United States Patent [19]

Fenne et al.

[11] Patent Number: 4,468,179

[45] Date of Patent: Aug. 28, 1984

[54] FUEL INJECTION PUMPING APPARATUS

[75] Inventors: Ivor Fenne, Greenford; Dorian F. Mowbray, Burnham, both of England

[73] Assignee: Lucas Industries, Public Limited Company, Birmingham, England

[21] Appl. No.: 460,776

[22] Filed: Jan. 25, 1983

[30] Foreign Application Priority Data

Feb. 5, 1982 [GB] United Kingdom ..... 8203447

[51] Int. Cl.[3] ..... F04B 29/00

[52] U.S. Cl. ..... 417/462; 123/450

[58] Field of Search ..... 417/215, 460, 462, 463, 417/486–488; 123/450

[56] References Cited

U.S. PATENT DOCUMENTS

| | | | |
|---|---|---|---|
| 2,561,519 | 7/1951 | Leech | 417/215 |
| 3,091,230 | 5/1963 | Evans et al. | 417/462 |
| 3,179,100 | 4/1965 | Glikin | 417/206 X |
| 4,173,959 | 11/1979 | Sosnowski et al. | 417/462 X |

*Primary Examiner*—William L. Freeh
*Assistant Examiner*—Paul F. Neils

[57] ABSTRACT

A fuel injection pumping apparatus for supplying fuel to an internal combustion engine is of the rotary distributor type having a distributor member including a transverse bore and a pair of pumping plungers slidable in the bore. At the outer ends of the plungers cam followers are mounted and first and second cam rings are provided having cam lobes to actuate the plungers respectively. The cam follower associated with one plunger has a shoe carrying a follower for engagement with the lobes of the first cam ring only and the cam follower associated with the other plunger has a shoe and a divided roller for engagement with the second cam ring which is also divided. The number of cam lobes on each cam ring is equal to the number of cylinders of the associated engine and the cam rings are positioned angularly relative to each other so that inward movement is imparted to each plunger at the same time during rotation of the distributor member.

5 Claims, 5 Drawing Figures

FUEL INJECTION PUMPING APPARATUS

BACKGROUND OF THE INVENTION

This invention relates to a fuel injection pumping apparatus of the kind comprising a rotary distributor member located in a housing and arranged in use to be driven in timed relationship with an associated engine, outlet ports in the housing for connection in use to the injection nozzles respectively of the associated engine, a pair of pumping plungers slidable within respective communicating radial bores in the distributor member, a delivery passage communicating with said bores and arranged to register in turn with said outlet ports during successive inward movements of the plungers, means for supplying fuel to said bores and annular cam means for imparting inward movement to the plungers.

In the case where the above type of pump is utilized to supply fuel to an engine having an even number of cylinders and therefore injection nozzles, the bores can be formed by a single drilling extending diametrically through the distributor member. The annular cam means in this case comprises an annular cam ring having a plurality of pairs of inwardly directed cam lobes on its internal surface, the number of pairs of cam lobes being equal to half the number of engine cylinders. Each plunger is moved inwardly at substantially the same time so that the loads on the distributor member are substantially balanced.

In order to supply fuel to an engine having an odd number of cylinders it is possible for say a three cylinder engine, to provide three plungers together with the associated bores, the three bores having their axes displaced by 120° about the axis of rotation of the distributor member. The annular cam ring is provided with three equi-angularly spaced lobes and again the loads acting on the distributor member are substantially balanced. A disadvantage of this arrangement is that the production of the bores in the distributor member is difficult and expensive. It is known to supply fuel to a three cylinder engine using an apparatus designed to supply fuel to a six cylinder engine and to connect alternate outlets to a drain. This solution is not however an ideal solution since half the quantity of fuel which is delivered by the apparatus flows to a drain and this is wasteful of energy as well as causing unnecessary heating of the fuel. This latter solution is not practical for an apparatus intended to supply fuel to a five cylinder engine because it would mean that the apparatus would have to be designed to supply fuel to a ten cylinder engine.

SUMMARY OF THE INVENTION

The object of the invention is to provide an apparatus of the kind specified in a form in which the supply of fuel to an engine having an odd number of cylinders is possible in a simple and convenient manner.

According to the invention in an apparatus of the kind specified said bores are defined by a diametrically disposed drilling and said cam means comprises first and second annular cam rings for actuating the plungers respectively each cam ring having a cam lobe or cam lobes equal in number to the number of cylinders of the associated engine, the cam rings being angularly displaced such that inward movement is imparted to the plungers at the same time during rotation of the distributor member.

BRIEF DESCRIPTION OF THE DRAWING

Examples of fuel pumping apparatus in accordance with the invention will now be described with reference to the accompanying drawings in which.

DESCRIPTION OF PREFERRED EMBODIMENTS

Figure 1:
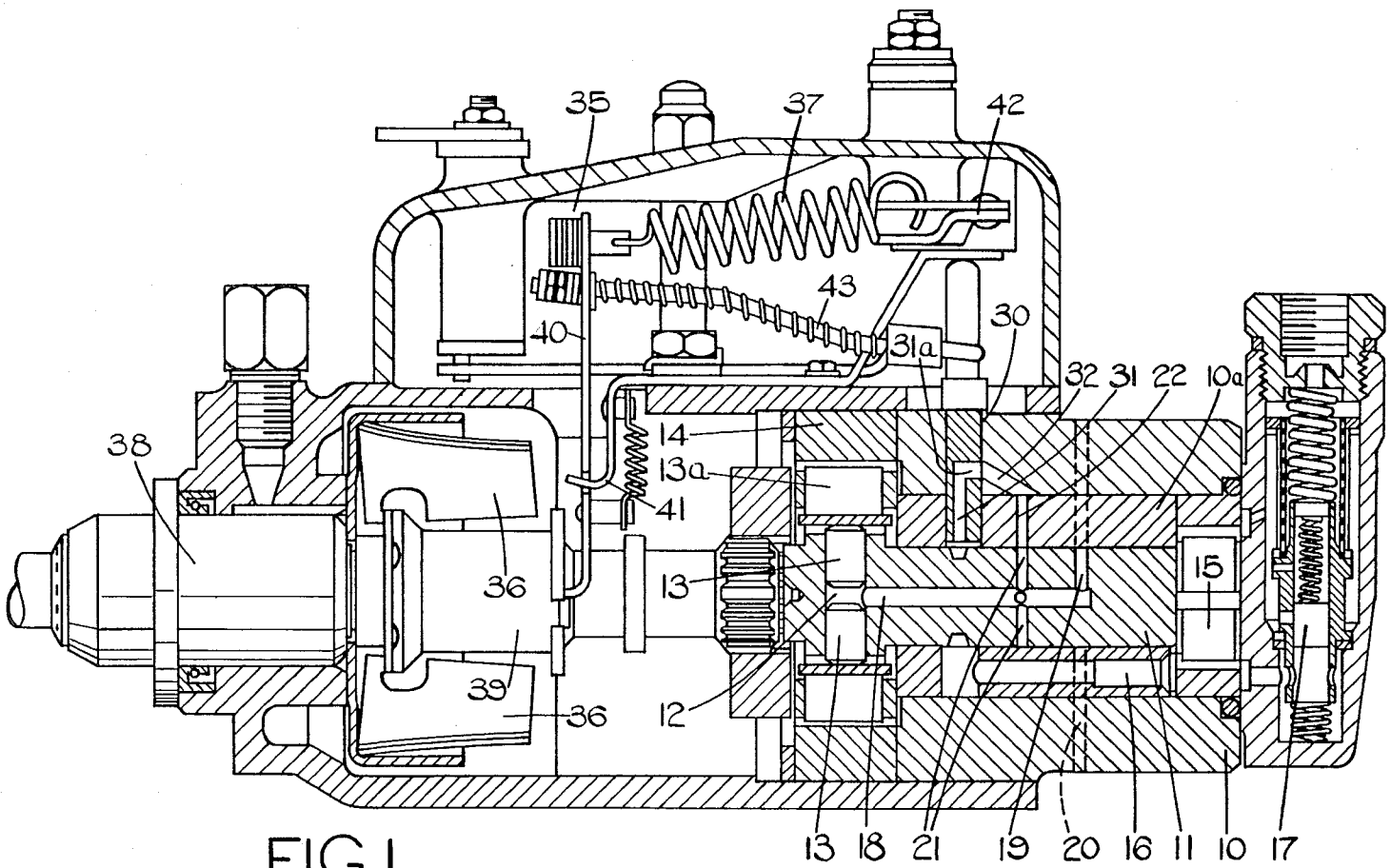
FIG. 1. PRIOR ART
FIG. 1 shows a known form of apparatus for supplying fuel to a four cylinder engine.

Referring to FIG. 1 of the drawings the apparatus comprises a housing 10 in which is located a fixed sleeve 10A which serves to support a rotary cylindrical distributor member 11. The distributor member at one end is coupled to a drive shaft 38 which in use is driven in time relationship with the associated engine. Formed in the distributor member is a diametrically disposed drilling 12 in which is mounted a pair of pumping plungers 13. At their outer ends the plungers 13 contact shoes which mount rollers 13A respectively and the rollers bear against the internal peripheral surface of an annular cam ring 14. Formed on the internal periphery of the cam ring are a plurality of pairs of cam lobes which as the distributor member rotates, impart inward movement to the plungers 13. The drilling 12 communicates with an axially extending passage 18 which is formed in the distributor member and which communicates with a radially disposed delivery passage 19. The passage 19 is positioned to register in turn and as the distributor member rotates, with a plurality of outlet ports 20 which extend through the housing 10 and the sleeve 10A. The outlet ports 20 in use, are connected to the fuel injection nozzles of the associated engine and the registration of the delivery passage 19 with an outlet port 20 takes place during the time when the plungers 13 are being moved inwardly.

At another point the axial passage 18 communicates with four radially disposed inlet passages 21 and these are positioned to register in turn with an inlet port 22 formed in the sleeve 10A and communicating with a port 32 formed in the wall of a radially extending bore defined in the sleeve and housing. Located within the bore is an angularly movable metering valve member 30 and formed in the valve member is an axially extending blind passage 31 which opens onto the periphery of the valve member to define a further port 31A. The inner end of the bore which accomodates the valve member 30 communicates with the outlet 16 of a feed pump 15 the rotary part of which is coupled to the distributor member 11. The apparatus also includes a control valve 17 which controls the output pressure of the feed pump by spilling fuel from the outlet of the pump to the inlet thereof.

In operation, during filling of the drilling 12, fuel flows from the outlet 16 of the feed pump by way of the passage 31, the registering ports 31A and 32, the inlet 22 and one of the inlet passage 21. Fuel is therefore supplied to the drilling to effect outward movement of the plungers. During continued rotation of the distributor member, the inlet passage 21 moves out of register with the inlet port 22 and the delivery passage moves into register with one of the outlets 20. During inward movement of the plungers fuel is displaced to the associated engine and the cycle is repeated. The degree of registration of the ports 31A and 32 which is determined by the angular setting of the metering valve member 30, determines the amount of fuel which is supplied to the drilling 12 and therefore the amount of fuel which is supplied to the associated engine.

The angular setting of the metering valve member 30 is determined by a governor mechanism which includes a plurality of weights 36 which are located within a cage carried by the drive shaft 38. As the rotational speed of the drive shaft increases, the weights move outwardly to impart axial movement to a sleeve 39 and this in turn causes pivotal movement of a lever 40 which is pivoted intermediate its ends, on a fulcrum plate 41. The end of the lever 40 remote from the sleeve is connected to a governor spring assembly which includes an idling spring 35 and a main governor spring 37. The idling spring is a light compression spring whereas the main governor spring is a coiled tension spring and the opposite end of the main governor spring is connected to an operator adjustable member 42 whereby the force exerted by the main governor spring on the lever 40 can be adjusted. In addition, the lever 40 is connected by a link member 43 to an arm which extends radially from and is coupled to the metering valve member 30. The arrangement is such that as the speed of operation increases the weights 36 will move outwardly against the action of the main governor spring 37 and during this movement angular movement will be imparted to the valve member which has the effect of reducing the degree of registration of the ports 31A and 32 so that the quantity of fuel supplied to the engine is decreased. If the force exerted by the main governor spring 37 is increased, the weights will be moved inwardly and movement of the various parts will take place in the opposite direction so that an increased quantity of fuel will be supplied to the engine.

The apparatus illustrated in FIG. 1 is for supplying fuel to a four cylinder engine and hence there are four outlet ports 20 and four inlet passages 21 although the number of inlet passages may be reduced by providing a further inlet 22.

Figure 2:
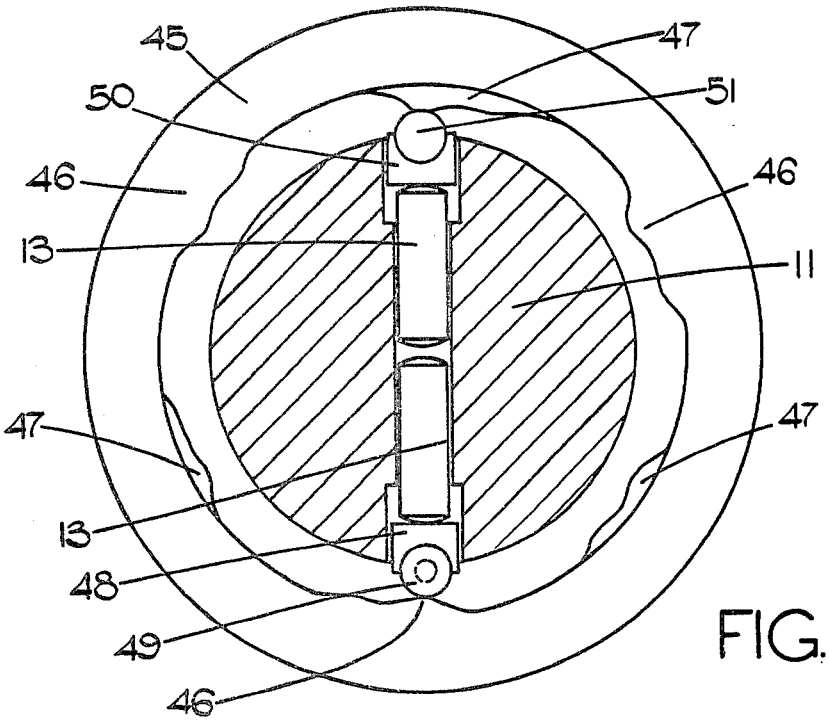
FIG. 2 is a side view of part of the apparatus of FIG. 1 modified in accordance with one example of the invention.
Figure 3:
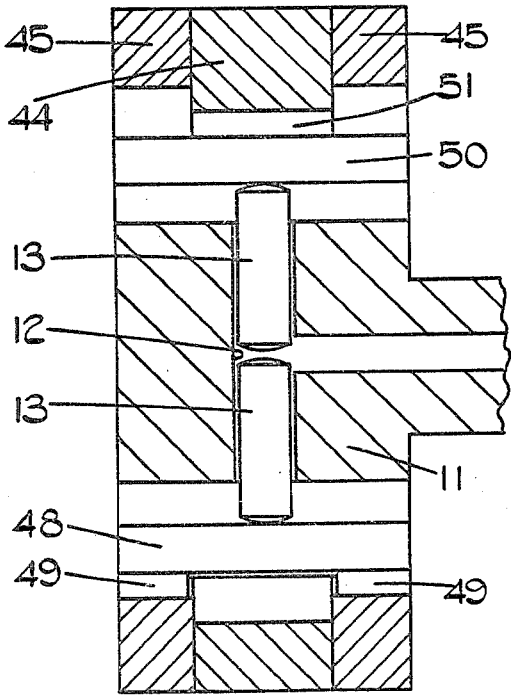
FIG. 3 is a part sectional view of the modification shown in FIG. 2, and FIGS. 4 and 5 are views similar to FIGS. 2 and 3 showing a further modification.

Referring now to FIGS. 2 and 3, parts which have the same function are provided with the same reference numerals and it will be noted that the drilling 12 is again diametrically disposed and contains a pair of plungers 13. The actuating cam however is different and is constituted by a first cam ring 44 and a second cam ring which conveniently is formed in two parts 45 disposed on opposite sides of the cam ring 44. The cam rings 45 are identical and each is provided with three equi-angularly disposed cam lobes 46. The cam lobes on the rings 45 are angularly aligned. The cam ring 44 is also provided with three lobes these being referenced 47 but as will be seen from FIG. 2, they are displaced angularly relative to the lobes 46 by an angle which is equal half the angle between adjacent lobes on each ring. The lobes 46 actuate one plunger and the lobes 47 the other plunger. As shown in FIG. 3 the lobes 46 actuate the lower plunger 13 and for this purpose there is associated with the lower plunger a shoe 48 which mounts a pair of rollers 49 for engagement with the lobes on the rings 45 respectively. Associated with the upper plunger is a further shoe 50 which mounts a single roller 51 for engagement by the lobes 47.

The apparatus shown in FIG. 2 is for supplying fuel to a three cylinder engine and each ring has three cam lobes on its internal surface. It will be seen that as the distributor member 11 rotates, delivery of fuel will occur at intervals of 120°. If the apparatus were to supply fuel to a five cylinder engine then each cam ring would have five lobes on its internal surface.

In the example shown in FIGS. 2 and 3 it has been mentioned that a pair of rollers 49 are provided to co-operate with the rings 45. In practice the pair of rollers 49 are constituted by a single roller which has its intermediate portion of reduced diameter so that during rotation of the distributor member, it clears the lobes 47.

Figure 4:
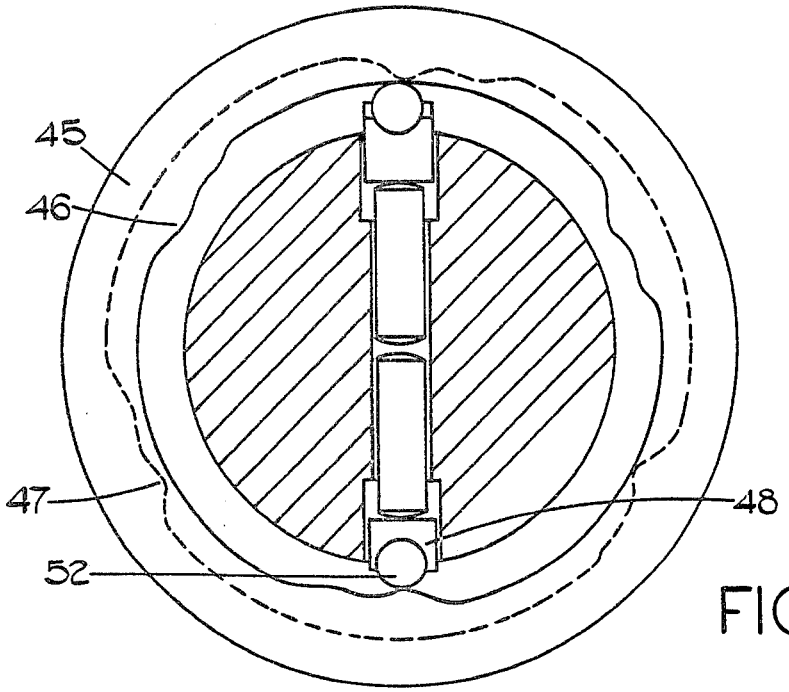
Figure 5:
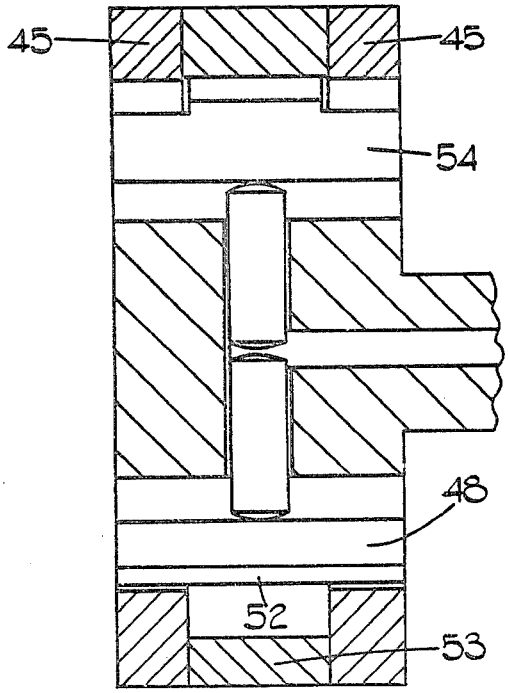

The arrangement shown in FIGS. 4 and 5 is basically the same as the arrangement shown in FIGS. 2 and 3 but in this case the roller 52 which co-operates with the lobes 46, is of constant diameter throughout its length. The central ring 53 is reduced thickness so that during rotation, the roller 52 will not engage the lobes 47. Whereas in the arrangement shown in FIGS. 2 and 3 the rings 44 and 45 are identical, in the arrangement shown in FIGS. 4 and 5 the central ring 53 is different, the lobes 47 being shaped so that the upper plunger 13 which is actuated by the lobes 47 has the same lift characteristic as the lower plunger. In order to cater for the reduced thickness of the central ring 53 the shoe 54 associated with the upper plunger is of increased radial thickness.

We claim:

1. A fuel injection pumping apparatus comprising a rotary distributor member located in a housing and arranged in use to be driven in timed relationship with an associated engine, outlet ports in the housing for connection in use to injection nozzles respectively of the associated engine, a pair of pumping plungers slidable within respective communicating radial bores in the distributor member, a delivery passage communicating with said bores and arranged to register in turn with said outlet ports during successive inward movements of the plungers, means for supplying fuel to said bores, annular cam means for imparting inward movement to the plungers, said bores being defined by a diametrically disposed drilling and said cam means comprising a first annular cam ring for actuating one plunger and a second annular cam ring for actuating the other plunger, each cam ring having a cam lobe or cam lobes equal in number to the number of cylinders of the associated engine, cam followers associable with the plungers respectively, said cam followers being located at the outer ends of the plungers respectively, said cam followers being constructed so that one follower and the associated plunger is actuated by the lobe or lobes on the first of said cam rings and the other follower and the associated plunger is actuated by the cam lobe or lobes on the second of said cam rings, the cam rings being angularly displaced such that inward movement is imparted to the plungers at the same time during rotation of the distributor member.

2. An apparatus according to claim 1 in which the second of said cam rings is divided, the two parts of the cam ring being located on opposite sides of the first of said cam rings.

3. An apparatus according to claim 2 in which each cam follower comprises a shoe which engages with the outer end of the plunger and a roller carried by the shoe for engagement with the lobes of the respective cam ring.

4. An apparatus according to claim 3 in which the roller of the follower associated with the second cam ring is divided into two parts for engagement with the two parts respectively of the second cam ring, the two cam rings being identical in size.

5. An apparatus according to claim 3 in which the first cam ring has a larger internal diameter than the second ring, the roller of the cam follower associated with the first cam ring having a length substantially equal to the width of the first cam ring, the shoe of the cam follower having an increased thickness to compensate for the larger internal diameter of the first cam ring.

* * * * *